US007337480B2

(12) United States Patent
Borino

(10) Patent No.: US 7,337,480 B2
(45) Date of Patent: Mar. 4, 2008

(54) BOX SPRING WRAP AND DUST RUFFLE SYSTEM

(76) Inventor: Anthony V. Borino, 2221 High Country Dr., Carrollton, TX (US) 75007

( * ) Notice: Subject to any disclaimer, the term of this patent is extended or adjusted under 35 U.S.C. 154(b) by 0 days.

(21) Appl. No.: 11/190,474

(22) Filed: Jul. 27, 2005

(65) Prior Publication Data

US 2007/0022533 A1 Feb. 1, 2007

(51) Int. Cl.
*A47G 9/04* (2006.01)

(52) U.S. Cl. ..... 5/493; 5/692; 297/219.1

(58) Field of Classification Search ..... 5/493, 5/692, 923

See application file for complete search history.

(56) References Cited

U.S. PATENT DOCUMENTS

| | | | | |
|---|---|---|---|---|
| 2,139,980 | A | 12/1938 | Simon | |
| 2,245,779 | A | 6/1941 | Meil | |
| 2,639,444 | A | 5/1953 | Monsabert | |
| 2,763,875 | A | 9/1956 | Pionikowski | |
| 3,999,233 | A | 12/1976 | Morris | |
| 4,141,097 | A | 2/1979 | Levinsohn et al. | |
| 4,587,683 | A | 5/1986 | Gardiner | |
| 4,807,316 | A | 2/1989 | Whipple | |
| 4,865,015 | A | 9/1989 | Hasty et al. | |
| 4,970,744 | A | 11/1990 | Davis | |
| 4,979,251 | A | 12/1990 | Lazar | |
| 5,046,207 | A | 9/1991 | Chamberlain | |
| 5,205,003 | A | 4/1993 | Green | |
| 5,271,112 | A | 12/1993 | Bible et al. | |
| 5,335,383 | A | 8/1994 | Schwind | |
| 5,353,456 | A | 10/1994 | Evans | |
| 5,621,931 | A * | 4/1997 | Hamilton | 5/493 |
| 5,715,553 | A * | 2/1998 | Baron et al. | 5/493 |
| 5,733,397 | A * | 3/1998 | McDaniel | 156/66 |
| 5,749,110 | A | 5/1998 | Gamble et al. | |
| 6,886,197 | B1 * | 5/2005 | Madigan | 5/482 |
| 7,007,325 | B1 * | 3/2006 | Gomeh | 5/496 |

* cited by examiner

*Primary Examiner*—Michael Trettel
(74) *Attorney, Agent, or Firm*—Anderson, Levine & Lintel

(57) ABSTRACT

A box spring wrap and dust ruffle system is disclosed. The box spring wrap has a strip of unbroken-loop material to which hooks, of a hook-and-loop fastener system, may be removably attached. The strip extends around the perimeter of the box spring wrap, and has contours corresponding to the locations of corners of the box spring. The box spring wrap also has decking, of a different material than the unbroken-loop material, serving as a top panel of the wrap when installed on a box spring; alternatively, the strip and decking may a unitary piece of unbroken-loop material. A strap of material that is attachable to the unbroken-loop material of the box spring wrap, or to the underside of the box spring itself, may be provided to secure the box spring wrap at the underside of the box spring. The dust ruffle of the system has hook fasteners attached to the reverse side along the top, and thus may be attached at any height of the box spring.

30 Claims, 4 Drawing Sheets

BOX SPRING WRAP AND DUST RUFFLE SYSTEM

STATEMENT REGARDING FEDERALLY SPONSORED RESEARCH OR DEVELOPMENT

Not applicable.

CROSS-REFERENCE TO RELATED APPLICATIONS

Not applicable.

BACKGROUND OF THE INVENTION

This invention is in the field of bedding, and is more specifically directed to box spring covers and dust ruffles.

Conventional covers and dust ruffles are commonly used in connection with box spring and mattress sets for beds. As is well known, dust ruffles extend from the bed to the floor to decoratively cover the open space below the bed frame, and also to help prevent the gathering of dust under the bed. Especially in the home, conventional box spring covers are generally fabricated of a material to match the comforter and draperies of the bedroom; often, the dust ruffle is formed integrally with the box spring cover. Box spring covers and dust ruffles for home use are typically either made according to a standard size, or custom made to fit a specific bed.

In the hospitality industry, typical beds receive significant wear over time, particularly at the sides of box springs. Side wear of hotel bed box springs typically renders the box springs unsightly long before the support provided by the box springs begins to degrade. Conventional box spring covers are used in hotels to provide both a decorative appearance for the bed box springs, usually coordinated with the room decor, and also to provide wear protection for the box spring sides. Dust ruffles are also commonly used with hotel beds, to provide additional decorative accent and to inhibit the gathering of dust, as noted above Various dust ruffle and box spring or mattress covers are known in the art, such as described in U.S. Pat. No. 2,139,980, U.S. Pat. No. 2,763,875, U.S. Pat. No. 3,999,233, U.S. Pat. No. 4,141,097, U.S. Pat. No. 4,587,683, U.S. Pat. No. 4,807,316, U.S. Pat. No. 5,335,383, and U.S. Pat. No. 5,353,456. In particular, U.S. Pat. No. 5,205,003 describes a dust ruffle that is attachable by way of hook-and-loop fasteners to a box spring cover.

Of course, hotels typically include beds of various sizes, such as full, queen, and king. The arrangement of beds in a hotel can often change over time, depending upon changes in demand for beds of different types in the various rooms. In addition, it is not uncommon for box springs and mattresses to be moved among the hotel rooms, depending upon the particular needs for a given day or season. As a box spring is moved from room to room, the associated box spring cover and dust ruffle must be changed to match the decor of the new room. Accordingly, conventional box spring covers that are coordinated with a particular room decor and that are made to fit a particular sized bed may not fit a different size box spring. For interchangeability of conventional box spring covers in hotels, therefore, a significant inventory of box spring covers must be maintained, for each bed size and each room decor choice.

In addition, the bed frames or platforms may vary in height from the floor among the various rooms of the hotel. As such, custom dust ruffles that fit a particular box spring and frame may not fit when used in connection with a different box spring and frame. Accordingly, the hotel inventory of dust ruffles must also be enlarged for all foreseeable combinations of box spring size, frame height, and room decor. Such increase in inventory is expensive, and as such either adds to the cost of maintaining the hotel or results in box spring covers and dust ruffles not being used (thus impacting the appearance of the rooms).

By way of further background, a significant portion of the daily maintenance of guest rooms involves the "making" of the beds by chambermaids, including the daily changing of sheets. The time required to make each bed thus has a significant impact on the productivity of the chambermaids. Many conventional dust ruffles and box spring covers, particularly those where the dust ruffle hangs from between the mattress and the box spring, are easily disturbed by the changing of the bedsheets, and must then be repositioned by the chambermaid to provide the desired appearance. In addition, some conventional dust ruffles and box spring covers may require removal of the mattress for repositioning of the dust ruffle and cover. Furthermore, as the dust ruffles themselves require periodic laundering, conventional dust ruffles require the time-consuming and cumbersome removal of the mattress both for removal of the dust ruffle for laundering, and its replacement. As such, the daily room maintenance budget and schedule must account for the time required for the removal of mattresses in repositioning, removing, and replacing conventional dust ruffles.

By way of further background, U.S. Pat. No. 5,749,110, issued May 12, 1998, entitled "Box Spring Wrap and Dust Ruffle System", commonly owned herewith and incorporated herein by this reference, describes a box spring wrap and dust ruffle system, in which the box spring wrap is fabricated of a material to which hooks, of a hook-and-loop fastener system, may be attached. The wrap has a length selected so that it is long enough to wrap around two sides and the foot of the perimeter of a large box spring, such as a king size; the wrap also preferably is of a length so as to be tied about the perimeter of a smaller size box spring, such as a full size or a queen size. Drawstrings are provided to secure the wrap around the box spring. The dust ruffle of the system has hook fasteners attached to the reverse side along the top, and thus may be attached at any height of the wrap when secured about a box spring.

BRIEF SUMMARY OF THE INVENTION

It is an object of this invention to provide a box spring cover and dust ruffle system in which the dust ruffle may be removed and repositioned without requiring removal of the overlying mattress, and in which installation of the box spring cover is facilitated.

It is a further object of the present invention to provide such a box spring cover and dust ruffle system in which the dust ruffle may be placed at varying heights, so as to allow the same dust ruffle to properly hang from beds of various platform or bed frame heights.

It is a further object of this invention to provide such a system that may be used in connection with box springs of multiple related sizes.

It is a further object of this invention to provide such a system that provides additional degrees of freedom in the placement of the dust ruffle.

Other objects and advantages of the present invention will be apparent to those of ordinary skill in the art having reference to the following specification together with its drawings.

The present invention may be implemented into a fitted box spring wrap that includes at least a strip of a material that serves as the loops in a hook-and-loop fastener system and that, when the box spring wrap is applied to a box spring, covers the full width of the perimeter edge, at least on two sides and the foot. The wrap is secured on the underside of the box spring when installed, for example by a strap that attaches from one side of the wrap to the other, or by stitching or an adhesive near the perimeter of the opening on the underside. A dust ruffle having hook fasteners along an edge may be attached to the box spring wrap at any height along the edge of the box spring so as to properly extend to the floor. Because the dust ruffle does not hang from between the mattress and box spring, it is not disturbed when the bedsheets are changed, and may be removed and replaced without removing the mattress from the bed.

DETAILED DESCRIPTION OF THE INVENTION

The present invention will be described in connection with its preferred embodiments, because it is contemplated that the benefits of this invention will be especially valuable in these particular implementations. However, it is also contemplated that this invention can be used to advantage in alternative implementations that may vary from the specific realizations of the preferred embodiments of the invention as described herein. Accordingly, it is to be understood that the following description is provided by way of example only, and is not intended to limit the true scope of this invention.

Figure 1A:
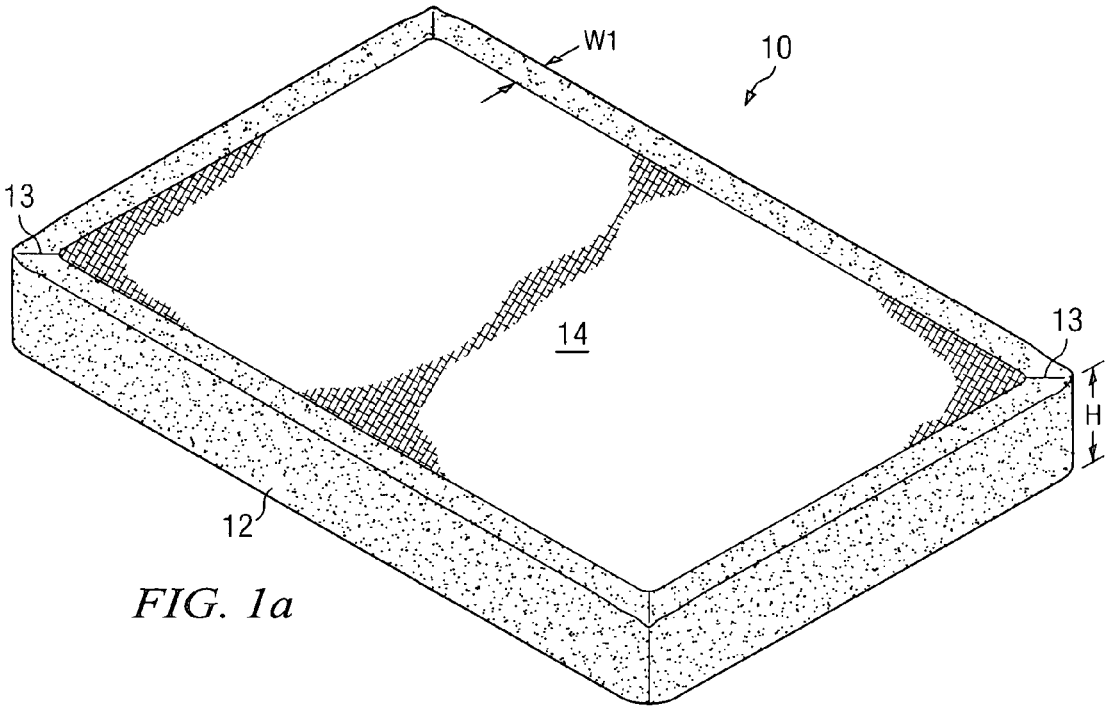
FIG. 1*a* is a perspective view of the top side of a box spring upon which the box spring wrap of a first preferred embodiment of this invention is installed.

Referring first to FIG. 1*a*, the construction of box spring wrap 10 according to a first preferred embodiment of the invention will now be described, by way of a perspective view of the top side of a box spring upon which wrap is installed. In the example shown in FIG. 1*a*, wrap 10 includes strip 12 that is fabricated of a material that is useful as one side of a hook-and-loop fastening system, and preferably is of an unbroken-loop fabric to which hook elements of a hook-and-loop fastener (e.g., a VELCRO fastener) will strongly attach. In this first preferred embodiment of the invention, strip 12 is fabricated of a knitted polyester material with a brushed finish, which is a readily available material in the textile field. If desired, the material of strip 12 may be in a quilted form to add stability, durability and elasticity. An example of a quilted implementation of wrap 10 would include knitted polyester material, backed by a polyurethane foam, such as on the order of 3/16" thick, in combination with a non-woven backing. This quilted construction for strip 12 will generally provide a tighter and more secure fit than a similarly sized non-quilted implementation.

Wrap 10 also includes decking 14, to which the top perimeter of strip 12 is sewn or otherwise permanently attached. Decking 14 is preferably a textured material to prevent decking 14 from slipping against the top surface of a box spring (not visible in FIG. 1*a*) when installed. Decking 14 may be constructed of a relatively thin fabric if desired, so long as it accomplishes the function of maintaining the shape and position of strip 12 when installed on the box spring.

Preferably, the corners of strip 12 include some contouring, to facilitate the fit around the box spring. This contouring is preferably effected by stitching corners 13 into the material of strip 12, as shown in FIG. 1*a*, at the approximate locations at which corners of the corresponding box spring are to fit when wrap 10 is installed, extending onto the top and bottom surfaces of the box spring as shown. If utilized, this contouring is preferably relatively gentle (i.e., rather than sharply defined) to permit wrap 10 to fit box springs having some variation in dimension, as described below.

Figure 1B:
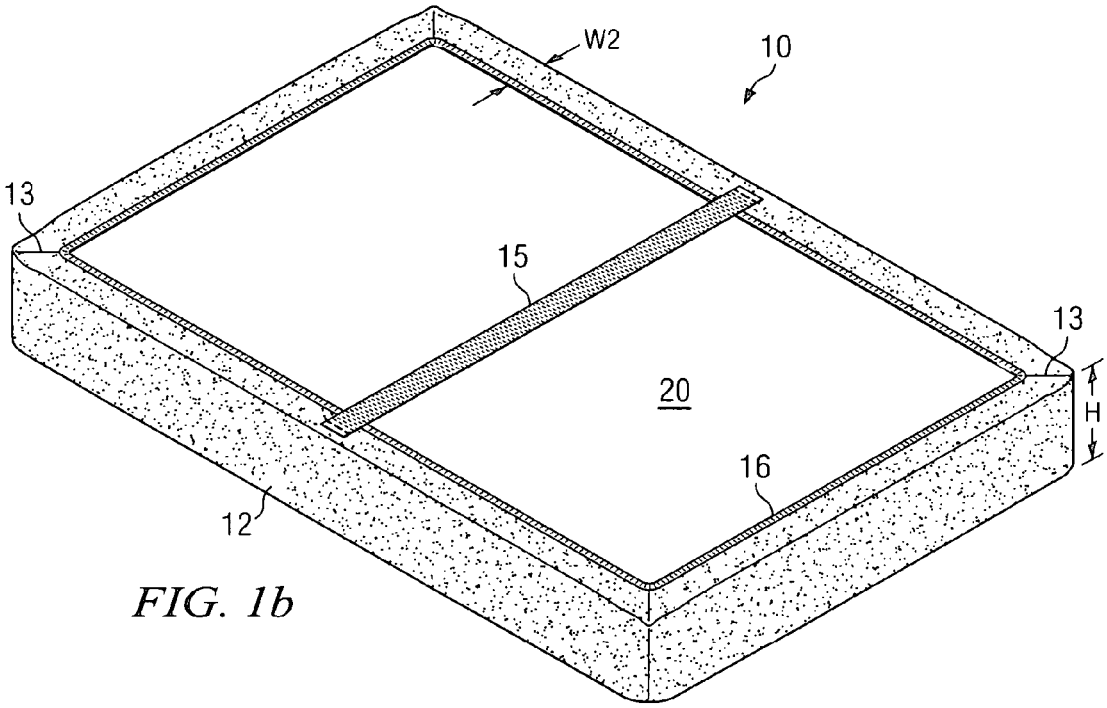
FIG. 1*b* is a perspective view of the underside of a box spring upon which the box spring wrap of the first preferred embodiment of this invention is installed.

FIG. 1*b* illustrates wrap 10 according to this first preferred embodiment of the invention, from a view from the underside of box spring 20, around which wrap 10 is installed. As shown in FIG. 1*b* in this example, strip 12 wraps around the bottom edge of box spring 20, terminating in elastic edge 16 according to this embodiment of the invention. Elastic edge 16 is formed of elastic material that is sewn or otherwise permanently attached to strip 12, and secures wrap 10 around box spring 20 in a similar fashion as a conventional fitted sheet secures around a conventional mattress. According to this first preferred embodiment of the invention, wrap 10 also includes bottom strap 15, which may be fabricated of a strap that is securable to opposing edges 16 of strip 12. Preferably, strap 15 is constructed of a backing material with a surface of hook elements of a hook-and-loop fastener system (e.g., the hook elements of a VELCRO fastener system) that adhere to the unbroken-loop material of strip 12. Alternatively, strap 15 includes patches of hook elements of a hook-and-loop fastener sewn to each of the distal ends of a backing or elastic material, in which case the patches would adhere strip 12, once installed. Alternatively, strap 15 may be sewn or otherwise secured to opposing edges 16 of strop 12 after wrap 10 has been placed around box spring 20.

Wrap 10 is installed over corresponding box spring 20 in a similar fashion as a conventional fitted sheet is installed over a conventional mattress. For example, it is contemplated that box spring 20 will be removed from a platform or bed frame, and wrap 10 stretched around box spring 20 in that fashion. Once wrap 10 is installed, strap 15 is then preferably extended across the opening between elastic edges 16 of wrap 10 on the underside of box spring 20, and attached by way of its hook elements to both opposing edges 16 of strip 12 as shown in FIG. 1*b*. Alternatively, considering that there is little need to change or launder wrap 10 because it is installed over box spring 20 (over which a mattress will be placed), strap 15 can be sewn, stapled, or otherwise permanently attached after wrap 10 is placed around box spring 20.

The dimensions of wrap 10 are preferably selected to provide some flexibility in the sizes of box spring 20 with which wrap 10 is to be secured. However, it is not contemplated that the same wrap 10 will be able to fit box springs 20 of all sizes (twin, full, and queen). Rather, it is contemplated that each size of wrap 10 (twin, full, and queen) will be able to fit box springs 20 of varying sizes within those classes. For example, the ranges of dimensions that wrap 10 according to this embodiment of the invention can fit are contemplated as:

| Wrap 10 size | Box spring size | Width (in.) | Width (in.) |
|---|---|---|---|
| Twin | Twin | 75 | 38 |
| Twin | Twin XL | 80 | 39 |
| Full | Full | 75 | 54 |
| Full | Full XL | 80 | 54 |
| Queen | Queen | 80 | 60 |

In other words, wrap 10 of "twin" size is contemplated to fit box springs 20 of both "twin" and "twin XL sizes, and wrap 10 of "full" size is contemplated to fit box springs 20 of both "full" and "full XL" sizes. The box spring of a "king" size bed typically consists of two "twin XL" size box springs laid adjacent to one another; according to this preferred embodiment of the invention, for ease of installation and inventory control, it is contemplated that each of the "twin" size box springs would have their own wrap 10 in forming the "king" size bed. It is contemplated also that wrap 10 is capable of covering varying box spring heights, for example from about six inches to as much as ten inches.

The ability of a single wrap 10 to fit a range of dimensions of box springs 20 is provided by its strip 12 having sufficient width to fully cover the perimeter edge of these box springs 20. With reference to FIGS. 1*a* and 1*b*, strip 12 in this example is contemplated to have a total width that is the sum of height H of box spring 20, plus width W1 of strip 12 extending from the topside corner of box spring 20 to decking 14, plus width W2 of strip 12 extending from the bottom-side corner of box spring 20 and terminating in elastic edge 16. For the example of the box spring dimensions in the above table, it is contemplated that the overall width of strip 12 will be on the order of 12 to 15 inches, allowing for a nominal box spring width of 6 inches, and overlap widths W1, W2 nominally about three to four inches each.

It is contemplated that the range of dimensions that can be covered by wrap 10 according to the preferred embodiments of the invention will be wider than the range of mattress dimensions covered by conventional fitted sheets. This wider range results from the ability to secure the underside of wrap 10 under box spring 20. Conventional fitted sheets are not secured across the underside of the mattress because sheets require frequent changing, especially in hotels, in which case the securing of the fitted sheet under the mattress would be extremely cumbersome. On the other hand, wrap 10 will seldom require changing or laundering, because it is installed over box spring 20 rather than the overlying mattress. This manner of use of wrap 10 is used to advantage, according to this invention, by the securing of wrap 10 on the underside of box spring 20 as shown in FIG. 1*b*.

Figure 1C:
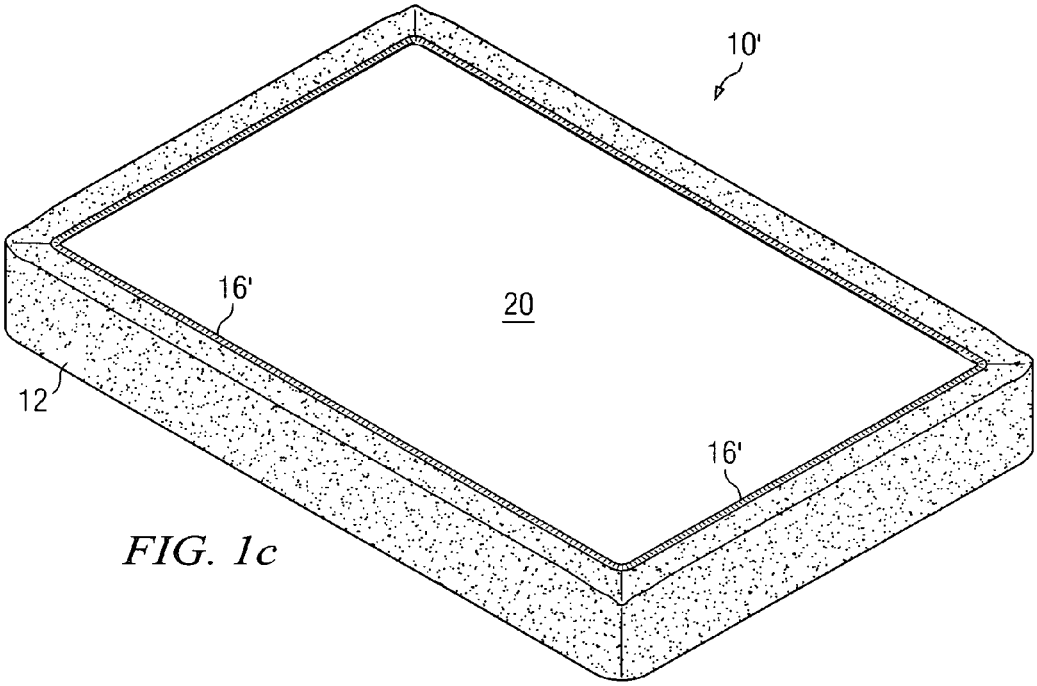
FIG. 1*c* is a perspective view of the underside of a box spring upon which the box spring wrap of a third preferred embodiment of this invention is installed.

FIG. 1*c* illustrates an alternative implementation of wrap 10', according to this first preferred embodiment of the invention. This alternative approach also takes advantage of the rarity with which wrap 10' will need to be changed or laundered once installed on box spring 20. As known in the art, conventional box springs have a thin fabric that is stapled or otherwise permanently attached over its bottom side, primarily to keep dust from gathering in the interior of box spring 20. Accordingly, in the alternative implementation shown in FIG. 1*c*, wrap 10' does not include strap 15. Instead, edges 16' of strip 12 are sewn, stapled, glued, or otherwise permanently attached to box spring 20, for example to the fabric covering the bottom side of box spring 20. Edges 16' may optionally be elastic, as in the case of wrap 10 of FIG. 1*b*, if desired.

Figure 2:
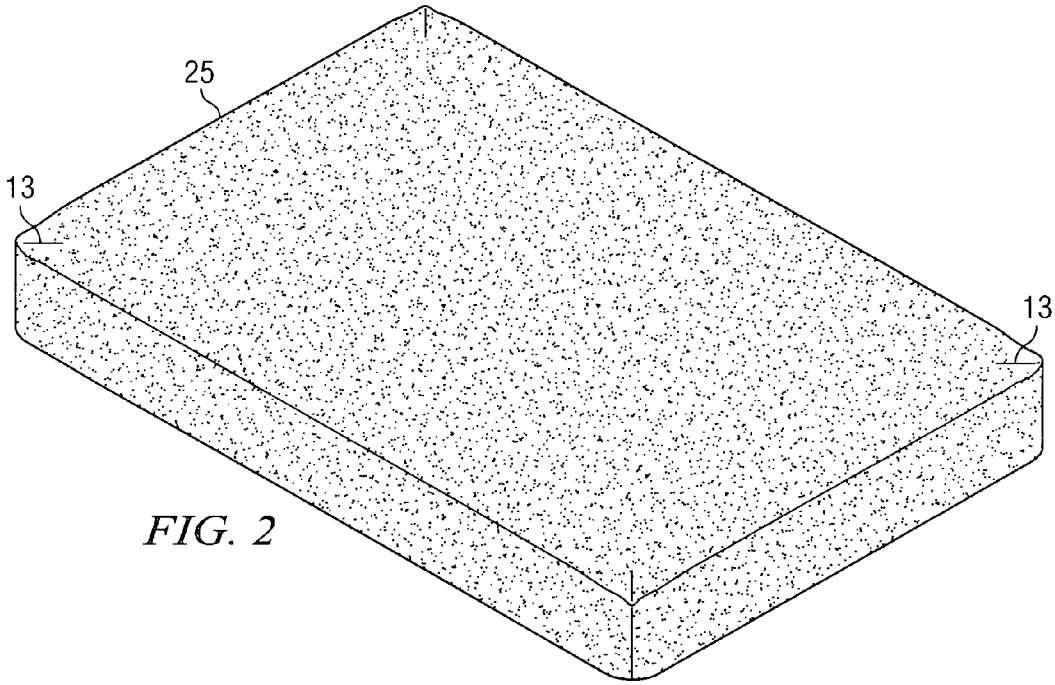
FIG. 2 is a perspective view of the top side of a box spring upon which the box spring wrap of a second preferred embodiment of this invention is installed.

Referring now to FIG. 2, wrap 25 according to a second preferred embodiment of the invention will now be described. Wrap 25 is formed, substantially in its entirety, of a material that is useful as one side of a hook-and-loop fastening system, and preferably of an unbroken-loop fabric to which hook elements of a hook-and-loop fastener (e.g., a VELCRO fastener) will strongly attach. As in the embodiment of FIGS. 1*a* through 1*c* described above, wrap 25 in this embodiment of the invention may be fabricated of a knitted polyester material with a brushed finish, and may be quilted to add stability, durability and elasticity, such as by way of a knitted polyester material, backed by a polyurethane foam, such as on the order of 3/16" thick, in combination with a non-woven backing. Contours 13 at the corners of wrap 25 are also preferably stitched into the material, to assist in the placement of wrap 25 around a box spring.

Of course, in this embodiment of the invention, wrap 25 does not include decking 14 as is provided in wrap 10 of FIGS. 1*a* through 1*c*. It is contemplated that the determination of which of these embodiments is to be utilized, for a given installation, will depend on a tradeoff between the cost of the unbroken-loop fabric of wrap 30 and the labor cost involved in the additional sewing of decking 14 to strip 12. It is contemplated that those skilled in the art, having reference to this specification, will be readily able to form the box spring wrap in the optimal manner.

On the underside of the box spring, according to this embodiment of the invention, wrap 25 is preferably secured by way of strap 15 and elastic edges 16, as in the embodiment described above relative to FIG. 1*b*, or alternatively is sewn or otherwise permanently attached to the underside of the box spring as in the embodiment described above relative to FIG. 1*c*. Again, such securing of wrap 25 about the underside of the box spring is made suitable by the relatively rare need to change or launder wrap 25. The manner of installation of wrap 25 about the box spring will depend, of course, on the way in which wrap 25 is to be secured on the underside of the box spring.

As noted above, wraps 10, 10', 25 according to the preferred embodiments of the invention are fabricated of a material that serves as the loops of a hook-and-loop fastener combination, such as VELCRO fasteners. As such, a mating element with hook fasteners may be attached at any location along the entire height H of wrap 10, 10', 25 and thus at any position along the vertical height of the underlying box spring 20 when wrap 10, 10', 25 is installed thereupon. This provides important advantages when wrap 10, 10', 25 is used in combination with a dust ruffle, as will now be described.

Figure 3:
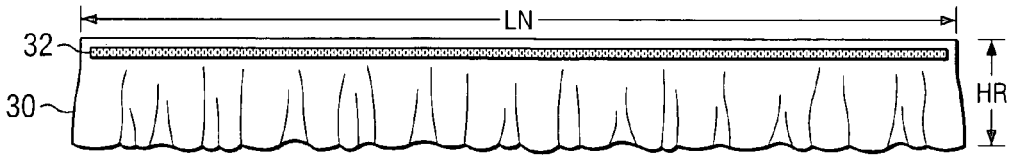
FIG. 3 is an elevation view of a dust ruffle for use in combination with the box spring wraps according to the preferred embodiments of this invention.

FIG. 3 illustrates dust ruffle 30 according to the preferred embodiment of the invention, viewed from its reverse side. Dust ruffle 30 is fabricated of a material selected primarily for its decorative coordination with draperies, wall coverings, and other elements of the room in which it is to be used, and as such may be fabricated from a wide range of materials. Dust ruffle 30 has length LN corresponding to the cumulative length of the sides and foot of the bed system to which it is to be attached. It is contemplated that dust ruffle 30 will be constructed for a single size of bed, for example to fit a full, queen, or king size bed system, considering that the headboard or wall may prevent dust ruffle 30 from overlapping onto the head end of the box spring. For example, length LN for dust ruffle 30 intended for use with a twin size bed may be approximately 158 inches (to include a so-called "twin XL" bed), while length LN for a queen size dust ruffle 30 may be approximately 200 inches.

Dust ruffle 30 has width HR corresponding to the height at which dust ruffle 30 is to be attached above the floor of the room. As will be described in further detail below, in hotels and other establishments in which dust ruffle 30 may be used on beds of varying frame or platform height, width HR should be selected so as to be at least the distance from the floor to the bottom of the box spring of the highest bed, but no wider than the distance from the floor to the top of the box spring of the lowest bed. It is contemplated that these constraints will permit a useable range of widths HR for dust ruffle 30.

As illustrated in FIG. 4, dust ruffle 30 has hook fasteners 32 attached as a strip near its top, on the reverse side of the material. Hook fasteners 32 are preferably attached as a continuous strip, as shown in FIG. 3, to provide a smooth and uniform attachment; alternatively, hook fasteners 32 may be attached periodically along the top of the reverse side of dust ruffle 30, if desired. Hook fasteners 32 are selected so as to securely attach to the material of wrap 10, as will now be described relative to FIGS. 5*a* and 5*b*.

Figure 4A:
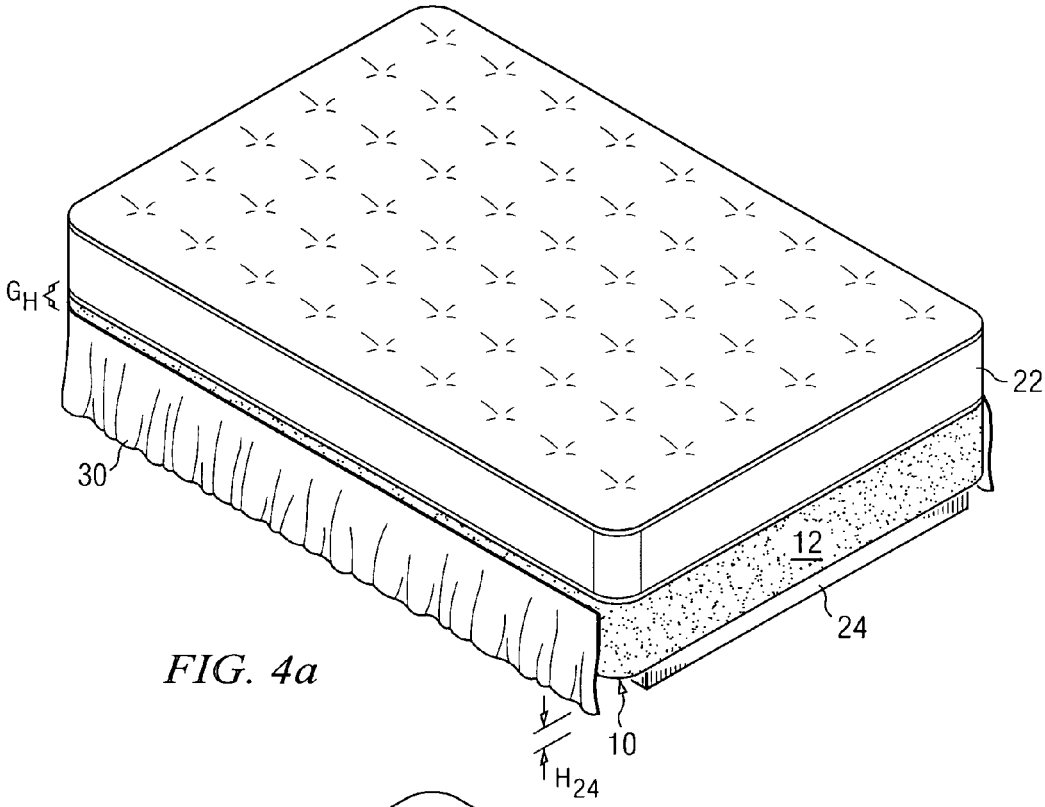
FIGS. 4*a* and 4*b* are a perspective views of a box spring and mattress bed system upon which a box spring wrap and dust ruffle is installed upon bed platforms of varying height, according to the preferred embodiments of the invention.

FIG. 4*a* illustrates an example of dust ruffle 30 as attached to wrap 10 (alternatively, wraps 10', 25 may be used) as installed on a bed. In this example, box spring 20 is seated upon platform 24, which has a relatively low height of $H_{24}$, such as on the order of two inches. Mattress 22 is in place on top of box spring 20 in the usual manner. Wrap 10 is in place around box spring 20, secured in the manner described above relative to FIG. 1*b* (or in the case of wrap 10', FIG. 1*c*). Dust ruffle 30 is attached to strip 12 of wrap 10 by pressing hook fasteners 32 on the reverse side (not visible in FIG. 4*a*) to strip 12 of wrap 10 at the appropriate height so as to fully extend to the floor, as shown in FIG. 4*a*. In this example, since platform 24 is relatively low, dust ruffle 30 is attached to strip 12 of wrap 10 near the top surface of box spring 20, leaving a relatively narrow gap $G_H$ between the top of dust ruffle 30 and the top surface of box spring 20.

As is evident from FIG. 4*a*, dust ruffle 30 may be readily attached to wrap 10, at the appropriate position, without requiring the removal of mattress 22 from the top of box spring 20. In addition, as is also evident from FIG. 4*a*, bedsheets may be placed onto and removed from mattress 22 without disturbing dust ruffle 30; even if dust ruffle 30 is inadvertently disturbed while changing the bedsheets or otherwise, dust ruffle 30 may be easily reattached to wrap 10, without requiring removal of mattress 22. Furthermore, in the event that the decor of the room is changed, one may readily replace the installed dust ruffle 30 with a new dust ruffle 30 of a different fabric or color, again without removing mattress 22 from box spring 20.

Figure 4B:
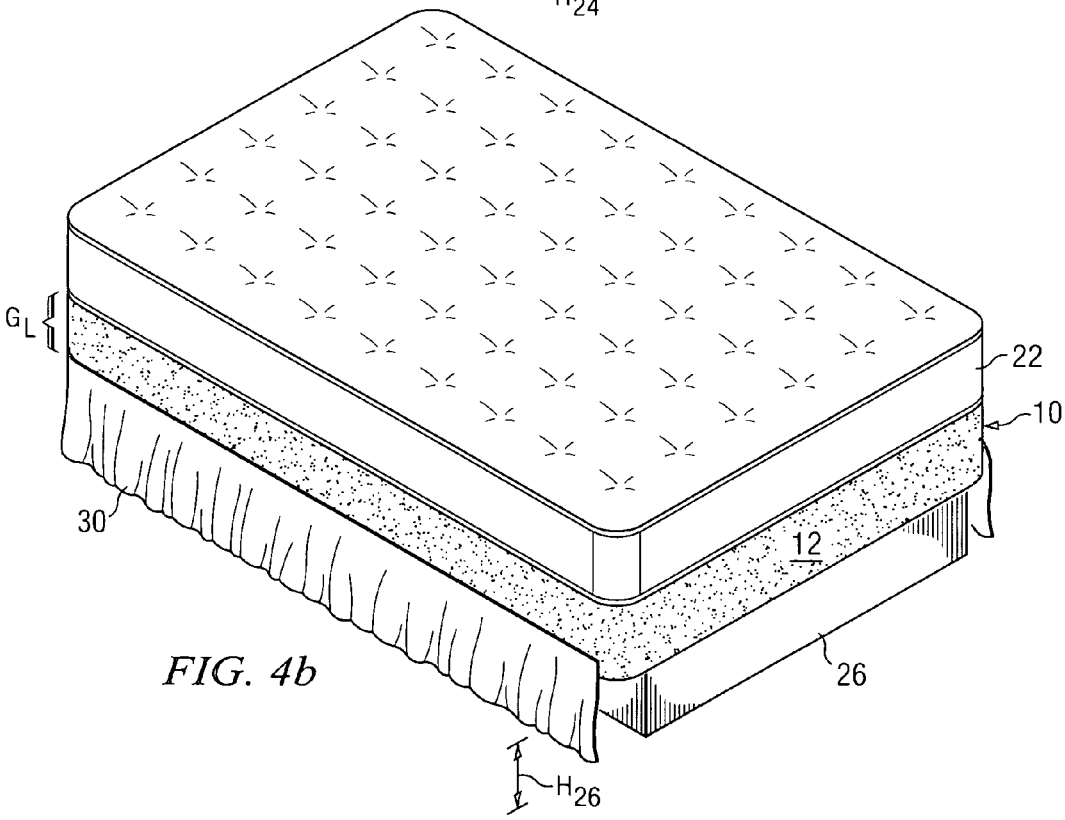

Referring now to FIG. 4*b*, an example of dust ruffle 30 as attached to wrap 10 in a bed on a higher platform 26 will now be described. In this example as in FIG. 4*a*, wrap 10 is secured to box spring 20, upon which mattress 22 rests. In this example, however, box spring 20 is placed on platform 26, which has a height $H_{26}$ that is higher than the height $H_{24}$ of platform 24 in FIG. 4*a*. For example, height $H_{26}$ may be on the order of six inches, as opposed to the two inch height $H_{24}$ of platform 24. In this example, dust ruffle 30 is again attached to strip 12 of wrap 10 by pressing hook fasteners 32 (not visible in FIG. 4*b*) to the fabric of strip 12 at the appropriate height so that dust ruffle 30 extends to the floor as shown. Because of the increased height $H_{26}$ of platform 26, however, dust ruffle 30 is attached to wrap at a relatively low position, leaving a substantial gap $G_L$ as shown in FIG. 4*b*.

A comparison of FIGS. 4*a* and 4*b* illustrate important benefits provided according to the preferred embodiment of the invention. As is readily evident, dust ruffle 30 may be attached to wrap 10, 10', 25 at any position along the sides of box spring 20, permitting the same dust ruffle 30 to be installed upon on beds of various heights. In the example of FIG. 4*a*, dust ruffle 30 having a width H of nine inches would be installed on wrap 10 at a location one inch below the top surface of eight-inch thick box spring 20 to properly hang to the floor, leaving gap $G_H$ at one inch; for the same dust ruffle 30 and box spring 20 in the example of FIG. 4*b*, dust ruffle 30 would be installed on wrap 10 at five inches from the top surface of box spring 20 (i.e., gap $G_L$ would be six inches). As a result, the inventory requirements would be much reduced for the operators of large multiple-bed establishments, as box springs 20, 20' of various sizes and their associated dust ruffles 30 may be easily interchanged from room to room, without concern for the height of the platform or bed frame upon which they are installed.

As evident from this description, it is contemplated that dust ruffle 30 is constructed with hook fasteners 32, while box spring wrap 10, 10', 25 is constructed with the unbroken loop fabric to which the hook fasteners 32 will attach as a hook-and-loop fastener (e.g., in the fashion of a VELCRO fastener). This arrangement is preferred, as it is currently understood in the art that hook fasteners are typically not produced in fabrics of substantial width. In other words, the narrower of two elements to be joined by way of a hook-and-loop fastener typically carries the hook element, with the wider element having the unbroken loop surface. Alternatively, of course, dust ruffle 30 may be constructed with the unbroken loop fabric while wrap 10, 10', 25 is constructed of material having the hook fasteners at its surface; while this construction is currently more costly than the preferred embodiments of the invention, it is contemplated that such an arrangement would work equivalently well.

According to these preferred embodiments of this invention, the installation of the box spring wrap is extremely easy, and is quite similar to placing a conventional fitted sheet around a conventional mattress, with the addition of either an underside strap using simple VELCRO fasteners, or alternatively a relatively simple sewing, stapling, or gluing operation. This installation is, of course, quite intuitive, and renders unnecessary any specialized training for the installation of the box spring wrap and dust ruffle system.

It is also contemplated that other fastener systems that permit secure yet non-destructive placement and removal of two elements to one another may alternatively be deployed in place of the hook-and-loop fastener system described herein. However, the hook-and-loop fastener system utilized according to the preferred embodiments of the invention is much preferred for this application, considering its attributes of durability, security, ease of use, reliability of re-use, robustness after being laundered, and the like.

Figure 5:
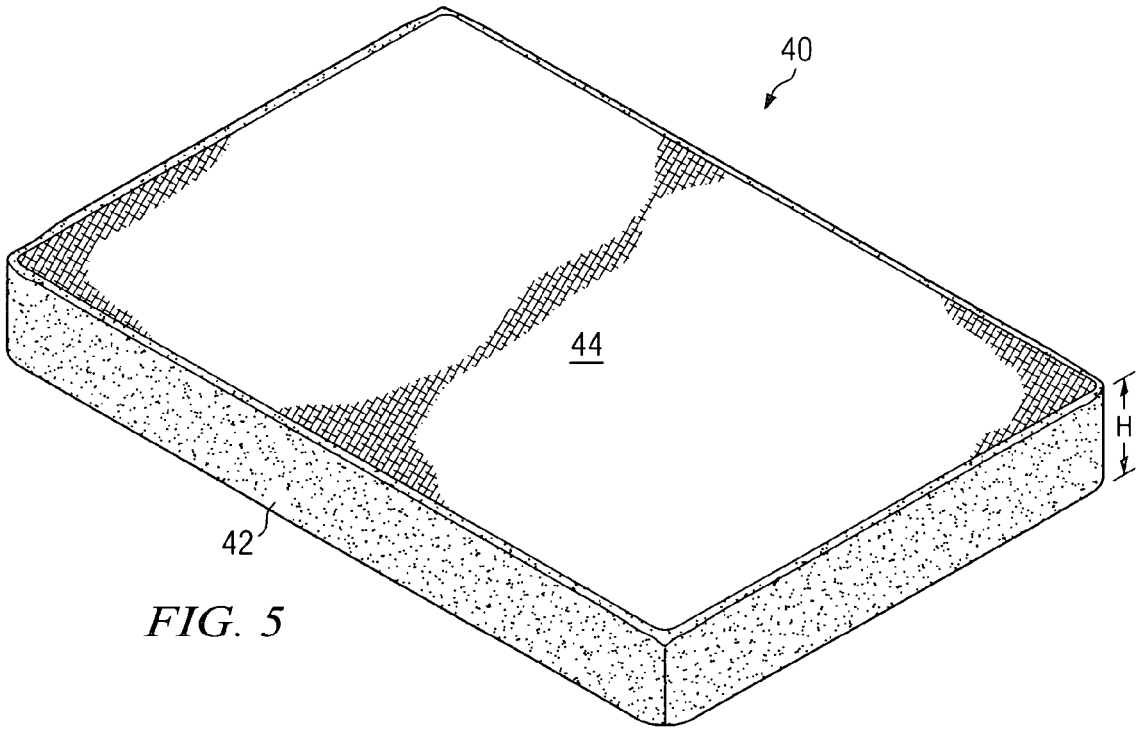
FIG. 5 is a perspective view of the top side and perimeter surface of a box spring constructed according to a third preferred embodiment of the invention.

Referring now to FIG. 5, the construction of box spring 40 according to another preferred embodiment of the invention will now be described. According to this embodiment of the invention, a separately installable and removable wrap is not provided, but rather box spring 40 is constructed to have a perimeter surface material 42 of an unbroken-loop fabric, to which hook fasteners of a hook-and-loop fastener system can reliably attach. Box spring 40, illustrated in FIG. 5, also includes conventional decking 44 of a conventional box spring top surface material, typically a thin yet durable fabric. According to this embodiment of the invention, surface 42 of the unbroken-loop fabric need not extend onto the top surface of box spring 40, and as such need only have a width H that corresponds to the height of box spring 40 itself, since this perimeter surface will be the only exposed portion of box spring 40 (e.g., as shown in FIGS. 4*a* and 4*b*. Each of decking 44 and surface material 42 are secured around a conventional box spring frame (not visible in FIG. 5), within which the conventional spring elements are deployed as suitable to provide the desired box spring function; underside decking (not visible in FIG. 5) may also be provided as desired.

In use, dust ruffle 30 will attach to surface 42 of box spring 40 in the manner illustrated in FIGS. 4*a* and 4*b*, with the position of dust ruffle 30 depending upon the height above the ground of which box spring 40 when in service.

Besides the ability to properly install dust ruffles at always the proper height, as described above, according to the preferred embodiments of the invention a dust ruffle may be easily removed and reattached without requiring removal of the mattress from the associated box spring. Furthermore, according to the preferred embodiments of the invention, the dust ruffles may attach to the box spring wraps along the sides of the box springs. Changing of the bedsheets and other bed maintenance are not only less likely to disturb the placement of the dust ruffles, but the reattachment of the dust ruffles is also quite simple. In addition, the dust ruffles according to the preferred embodiment of the invention will detach without tearing when accidentally stepped upon, in contrast to many styles of conventional dust ruffles which tear in such an event.

While this invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

I claim:

1. A box spring wrap and dust ruffle system, comprising:

a box spring wrap, comprising:

a strip of a first material of a two-material fastener system having a width that is wider than a box spring height according to a plurality of box spring sizes, and having a length that extends around the perimeter of each of the plurality of box spring sizes; and a decking panel of material coupled to the strip on one edge, the other edge of the strip defining an opening;

a dust ruffle comprising:

a strip of decorative material, having a length corresponding to the length of two sides and a foot of one of the plurality of box spring sizes; and fasteners of a second material of the two-material fastener system, located along an edge of the strip of decorative material, for attaching the dust ruffle to the box spring wrap at any location of the wrap.

2. The system of claim 1, wherein the first material of the two-material fastener system comprises hook fasteners of a hook-and-loop fastener system;

and wherein the second material of the two-material fastener system comprises unbroken-loop material.

3. The system of claim 1, wherein the first material of the two-material fastener system comprises unbroken-loop material;

and wherein the second material of the two-material fastener system comprises hook fasteners of a hook-and-loop fastener system.

4. The system of claim 3, wherein the strip of unbroken-loop material is contoured at selected locations corresponding to corners of a box spring.

5. The system of claim 3, wherein the material of the strip of the box spring wrap is a knitted polyester material.

6. The system of claim 3, wherein the decking panel of the box spring wrap is formed of the same material as the strip.

7. The system of claim 6, wherein the strip and decking panel of the box spring wrap constructed as a unitary piece of material.

8. The system of claim 1, wherein the decking panel of the box spring wrap is formed of a different material from the strip.

9. The system of claim 1, wherein the box spring wrap further comprises:

a strap, extending between opposing edges of the strip across a bottom opening of the box spring wrap.

10. The system of claim 9, wherein the first material of the two-material fastener system comprises unbroken-loop material;

wherein the second material of the two-material fastener system comprises hook fasteners of a hook-and-loop fastener system;

and wherein the strap comprises a length of material having hook fasteners along its surface, the hook fasteners for removably attaching the strap to the opposing edges of the strip.

11. The system of claim 9, wherein the first material of the two-material fastener system comprises unbroken-loop material;

wherein the second material of the two-material fastener system comprises hook fasteners of a hook-and-loop fastener system;

and wherein the strap is comprised of a length of backing material, and hook fasteners attached to the backing material at least at its ends, the hook fasteners for removably attaching the strap to the opposing edges of the strip.

12. A box spring wrap and dust ruffle system, comprising:

a box spring wrap, comprising:

a strip of unbroken-loop material having a width that is wider than a selected box spring height, and having a length that extends around the perimeter of a selected box spring size;

a decking panel of material coupled to the strip on a first edge, a second edge of the strip defining an opening; and means, coupled to the second edge of the strip, for securing the wrap to a box spring;

a dust ruffle comprising:

a strip of decorative material, having a length corresponding to the length of two sides and a foot of one of the plurality of box spring sizes; and hook fasteners, located along an edge of the strip of decorative material, for attaching the dust ruffle to the box spring wrap at any location of the wrap.

13. The system of claim 12, wherein the securing means comprises:

elastic material, attached along the perimeter of the second edge of the strip.

14. The system of claim 13, wherein the securing means further comprises:

a strap, extending between opposing edges of the strip across a bottom opening of the box spring wrap.

15. The system of claim 14, wherein the strap comprises a length of material having hook fasteners along its surface, the hook fasteners for removably attaching the strap to the opposing edges of the strip.

16. The system of claim 14, wherein the strap is comprised of a length of backing material, and hook fasteners attached to the backing material at least at its ends, the hook fasteners, for removably attaching the strap to the opposing edges of the strip.

17. The system of claim 12, wherein the strip of unbroken-loop material is contoured at selected locations corresponding to corners of a box spring.

18. The system of claim 12, wherein the unbroken-loop material of the strip of the box spring wrap is a knitted polyester material.

19. The system of claim 12, wherein the decking panel of the box spring wrap is formed of the same material as the strip.

20. The system of claim 19, wherein the strip and decking panel of the box spring wrap are constructed as a unitary piece of material.

21. The system of claim 20, wherein the decking panel of the box spring wrap is formed of a different material from the strip.

22. A method of installing a dust ruffle on a bed comprising:

applying a box spring wrap around a box spring, the box spring wrap comprised of a strip of a first material of a two-material fastener system having a width that is wider than the height of the box spring, and having a length that extends around the perimeter of the box spring, the box spring wrap also comprising decking extending over a top surface of the box spring after the box spring wrap is applied around the box spring;

securing the box spring wrap at an under-surface of the box spring;

removably attaching a dust ruffle to the box spring wrap, the dust ruffle comprising a strip of decorative material, having a length corresponding to the length of two sides and a foot of the box spring, and fasteners of a second material of the two-material fastener system, located along an edge of the strip of decorative material, for attaching the dust ruffle to the box spring wrap at any location of the wrap, for engaging with the first material of the box spring wrap at a selected height.

23. The method of claim 22, wherein the step of securing the box spring wrap comprises:

sewing an edge of the box spring wrap to material at the under-surface of the box spring.

24. The method of claim 22, wherein the step of securing the box spring wrap comprises:

stapling an edge of the box spring wrap to material at the under-surface of the box spring.

25. The method of claim 22, wherein the step of securing the box spring wrap comprises:

gluing an edge of the box spring wrap to material at the under-surface of the box spring.

26. The method of claim 22, wherein the step of securing the box spring wrap comprises:

attaching a strap between opposing edges of the box spring wrap across the under-surface of the box spring.

27. The method of claim 26, wherein the first material of the two-material fastener system comprises unbroken-loop material;

wherein the second material of the two-material fastener system comprises hook fasteners of a hook-and-loop fastener system;

wherein the strap comprises hook fasteners at its opposite ends;

and wherein the step of securing the box spring wrap comprises:

attaching the hook fasteners of the strap to opposing edges of the box spring wrap at the under-surface of the box spring.

28. The method of claim 26, wherein the box spring wrap further comprises elastic material attached along the perimeter of the edge of the strip opposite from the decking, so that the step of securing the box spring wrap further comprises releasing the box spring wrap after applying it to the box spring, so that the elastic material assists in securing the box spring wrap to the box spring.

29. The method of claim 22, wherein the first material of the two-material fastener system comprises hook fasteners of a hook-and-loop fastener system;

and wherein the second material of the two-material fastener system comprises unbroken-loop material.

30. The method of claim 22, wherein the first material of the two-material fastener system comprises unbroken-loop material;

and wherein the second material of the two-material fastener system comprises hook fasteners of a hook-and-loop fastener system.

* * * * *